US008813700B2

(12) United States Patent
Dupuis et al.

(10) Patent No.: US 8,813,700 B2
(45) Date of Patent: Aug. 26, 2014

(54) CAMSHAFT ADJUSTMENT MECHANISM HAVING A LOCKING APPARATUS

(71) Applicants: Craig Dupuis, Winsor (CA); Michael Busse, Herzogenaurach (DE)

(72) Inventors: Craig Dupuis, Winsor (CA); Michael Busse, Herzogenaurach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 3 days.

(21) Appl. No.: 13/653,758

(22) Filed: Oct. 17, 2012

(65) Prior Publication Data

US 2013/0104822 A1 May 2, 2013

Related U.S. Application Data

(60) Provisional application No. 61/554,756, filed on Nov. 2, 2011.

(51) Int. Cl.
*F01L 1/344* (2006.01)

(52) U.S. Cl.
CPC ..... *F01L 1/3442* (2013.01); *F01L 2001/34469* (2013.01); *F01L 2001/34463* (2013.01)
USPC ..... 123/90.17

(58) Field of Classification Search
CPC ..... F01L 1/3442; F01L 2001/34469; F01L 2001/34463
USPC ..... 123/90.15, 90.17
See application file for complete search history.

(56) References Cited

U.S. PATENT DOCUMENTS

| | | | | |
|---|---|---|---|---|
| 5,901,674 | A | 5/1999 | Fujiwaki | |
| 2002/0139332 | A1 * | 10/2002 | Takenaka | 123/90.17 |
| 2009/0260591 | A1 * | 10/2009 | Yamaguchi et al. | 123/90.17 |
| 2010/0139593 | A1 * | 6/2010 | Takemura | 123/90.17 |
| 2011/0271919 | A1 * | 11/2011 | Kaneko | 123/90.15 |
| 2012/0000437 | A1 * | 1/2012 | Ozawa et al. | 123/90.15 |

FOREIGN PATENT DOCUMENTS

| | | |
|---|---|---|
| EP | 0857859 | 8/2003 |

* cited by examiner

*Primary Examiner* — Thomas Denion
*Assistant Examiner* — Jorge Leon, Jr.
(74) *Attorney, Agent, or Firm* — Volpe and Koenig, P.C.

(57) ABSTRACT

A camshaft adjustment mechanism is provided having a rotor adapted to be connected to a camshaft, a stator arranged around the rotor, and a cover associated with the stator. An advance chamber and a separate retard chamber are formed between the rotor and the stator and separated from each other by a vane extending from the rotor. The camshaft adjustment mechanism further includes a locking apparatus adapted to lock the rotor from rotation. A first oil control valve is associated with the advance chamber and the retard chamber to control oil flow to the advance chamber and the retard chamber. A second oil control valve is associated with the locking apparatus to control oil flow to the locking apparatus.

17 Claims, 9 Drawing Sheets

CAMSHAFT ADJUSTMENT MECHANISM HAVING A LOCKING APPARATUS

CROSS-REFERENCE TO RELATED APPLICATIONS

This application claims the benefit of U.S. provisional Application No. 61/554,756, filed Nov. 2, 2011, which is incorporated herein by reference as if fully set forth.

FIELD OF INVENTION

This application is generally related to camshaft adjustment mechanisms and more particularly related to camshaft adjustment mechanisms having a locking apparatus.

BACKGROUND

Camshaft adjustment mechanisms, also known as variable camshaft timing devices, are used in the automotive field to control the timing of the camshaft with respect to the crankshaft. By advancing or retarding the angular position of the camshaft, the timing of the camshaft can be adjusted while the engine is operating to account for parameters such as engine load and speed. The use of a camshaft adjustment mechanism allows the valve lift event timing of an engine to be changed, which can help increase fuel efficiency, engine performance, and idle stability, while reducing emissions.

In known camshaft adjustment mechanisms, a hydraulic operating fluid such as engine oil is selectively provided to cavities formed in the camshaft adjustment mechanism to vary the angular position of the camshaft relative to the crankshaft, which results in the camshaft timing being advanced or retarded. An oil control valve is generally used to control the flow of oil to advance, retard, or hold the camshaft position. However, in some cases the supply of engine oil to the camshaft adjustment mechanism is cut off when the engine is stopped, and the camshaft position cannot be maintained during this time. In situations where the engine has been stopped for an extended period of time before being restarted, the cavities of the camshaft adjustment mechanism usually have very low or no oil pressure. The camshaft adjustment mechanism is thus in an uncontrolled and unstable condition. When the engine is started, the camshaft adjustment mechanism violently rotates between the most advanced and most retarded positions until sufficient oil pressure is supplied to the internal cavities. This results in large amounts of noise during engine start and increased wear and damage to the camshaft adjustment mechanism.

To address this problem, various locking mechanisms have been used to lock the camshaft adjustment mechanism from rotation during engine start. One such locking mechanism utilizes a single locking pin to maintain the camshaft adjustment mechanism in an intermediate position when the engine is stopped. However, there is a tradeoff between the locking pin clearance and locking reliability. To minimize the locking pin clearance so that the pin does not move around in a corresponding opening during engine start to produce unwanted noise and vibration, the opening must have approximately the same size as the pin. The tradeoff is that with a small clearance, it is difficult to ensure that the pin fully engages with the corresponding opening in the locked position. Where the pin is only partially engaged with the opening, locking may fail to occur and the additional wear on the pin can cause durability problems. In other known locking mechanisms where two locking pins are used, the pins are actuated by oil flow through the same oil channels used to advance and retard the camshaft position, and controlled by the same proportional oil control valve as the camshaft adjustment mechanism. The downside to these locking mechanisms is that locking and unlocking can only occur reliably under certain conditions. Because the advancing and retarding operation is generally done at high speeds, actuation of the locking pins through the same oil channels used to advance and retard the camshaft position must also be done at those high speeds. This makes it more difficult to control the timing for locking the camshaft adjustment mechanism, decreases locking reliability, and increases the wear on the pins. Therefore, a need exists for a camshaft adjustment mechanism having a locking mechanism that can reliably lock the camshaft adjustment mechanism at a desired engine start position under various operating conditions, while minimizing noise, vibration, and harshness.

SUMMARY

A camshaft adjustment mechanism is disclosed, the camshaft adjustment mechanism having a rotor adapted to be connected to a camshaft and to rotate between an advanced position and a retarded position. The camshaft adjustment mechanism further includes a stator arranged around the rotor, a cover associated with the stator, and an advance chamber and a retard chamber formed between the rotor and the stator, the advance chamber and the retard chamber being separated from each other by a vane extending from the rotor. A locking apparatus is adapted to lock the rotor from rotation. A first oil control valve is associated with the advance chamber and the retard chamber to control oil flow to the advance chamber and the retard chamber. A second oil control valve is associated with the locking apparatus to control oil flow to the locking apparatus.

Another camshaft adjustment mechanism is disclosed having a rotor arranged inside of a housing and adapted to be connected to a camshaft, an advance chamber and a retard chamber formed between the rotor and the housing that are separated by a vane extending from the rotor, and an independently controlled locking apparatus adapted to lock the rotor from rotating relative to the housing. A first oil control valve controls oil flow to the advance chamber and the retard chamber to actuate the rotor between an advanced position and a retarded position. A second oil control valve controls oil flow to the locking apparatus to actuate the locking apparatus between a locked position and an unlocked position.

A method of locking a camshaft adjustment mechanism is also disclosed. The method includes the steps of providing a camshaft adjustment mechanism having a rotor adapted to be connected to a camshaft, a housing arranged around the rotor, such that an advance chamber and a retard chamber are formed between the rotor and the housing, an advance oil passage in the rotor in communication with the advance chamber, and a retard oil passage in the rotor in communication with the retard chamber. A first oil control valve is provided to control oil flow through the advance oil passage and the retard oil passage. A locking apparatus is provided that includes a pair of locking pins associated with the rotor and at least one locking groove formed in the housing, the pair of locking pins being adapted to move between a retracted position and an extended position. A locking oil passage is provided in the rotor or the camshaft in communication with the at least one locking groove formed in the housing. The method further includes the steps of providing a second oil control valve to control oil flow through the locking oil passage, and actuating the locking apparatus between a locked position and an unlocked position by selectively supplying oil from the second oil control valve to the at least one locking groove formed in the housing.

For the sake of brevity, this summary does not list all aspects of the present camshaft adjustment mechanism and method of locking a camshaft adjustment mechanism, which are described in further detail below and in the claims.

BRIEF DESCRIPTION OF THE DRAWINGS

The foregoing summary, as well as the following detailed description of the preferred embodiments, will be better understood when read in conjunction with the appended drawings. For the purpose of illustrating the invention, there is shown in the drawings embodiments which are presently preferred. It should be understood, however, that the invention is not limited to the precise arrangement shown.

DETAILED DESCRIPTION OF THE PREFERRED EMBODIMENTS

Figure 1:
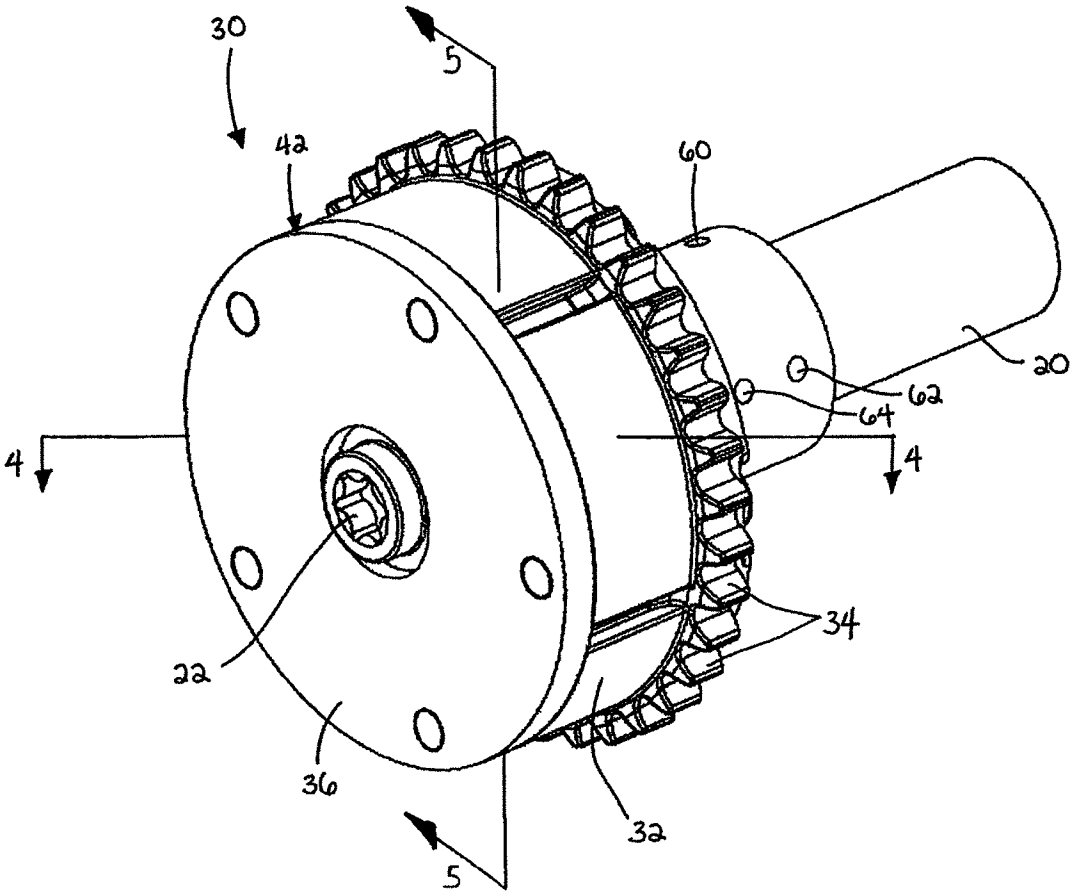
FIG. 1 is a perspective view of a portion of a camshaft equipped with an embodiment of the present camshaft adjustment mechanism.

Certain terminology is used in the following description for convenience only and is not limiting. The words "front," "back," "top," "bottom," "left," "right," "inner," "outer," "clockwise," and "counterclockwise" designate directions in the drawings to which reference is made. Additionally, the terms "a" and "one" are defined as including one or more of the referenced item unless specifically noted otherwise. A reference to a list of items that are cited as "at least one of a, b, or c" (where a, b, and c represent the items being listed) means any single one of the items a, b, or c, or combinations thereof. The terminology includes the words specifically noted above, derivatives thereof, and words of similar import.

Figure 2:
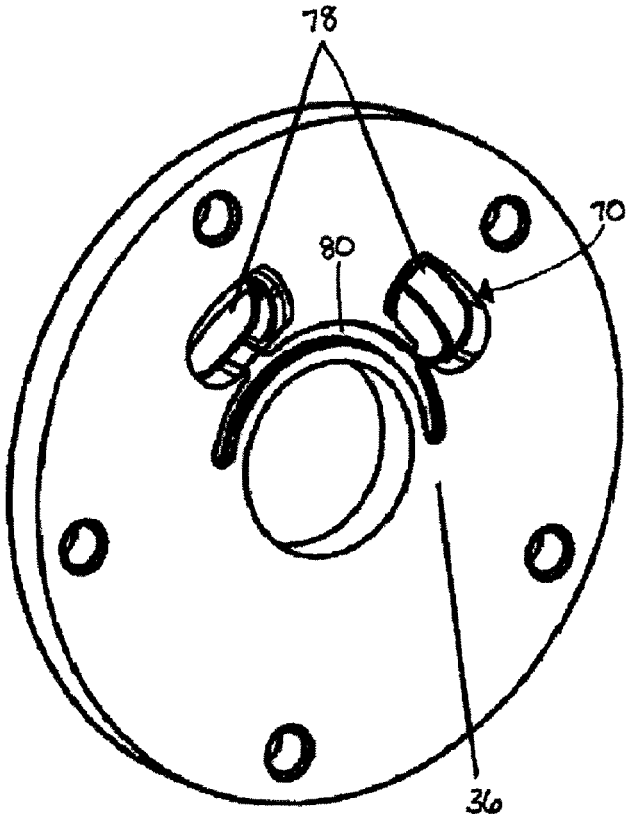
FIG. 2 is a perspective view of an inside of the cover of the camshaft adjustment mechanism shown in FIG. 1.
Figure 3:
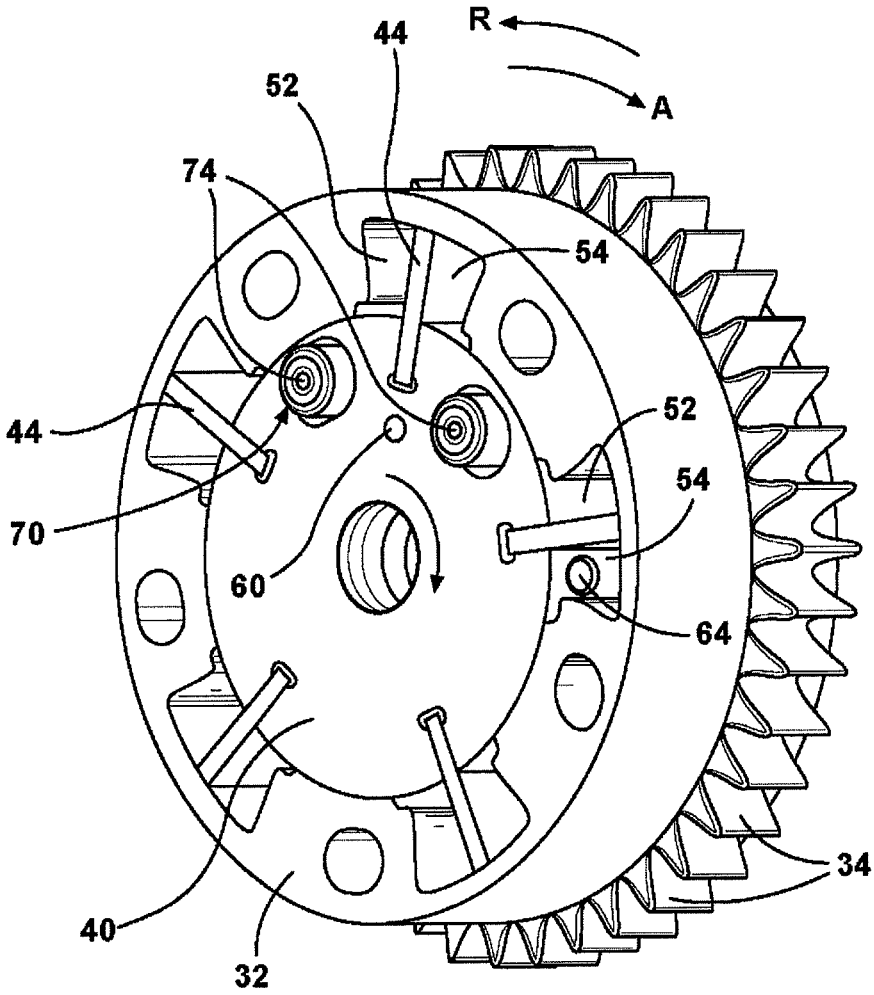
FIG. 3 is a perspective view of the camshaft adjustment mechanism shown in FIG. 1 without the cover.
Figure 4:
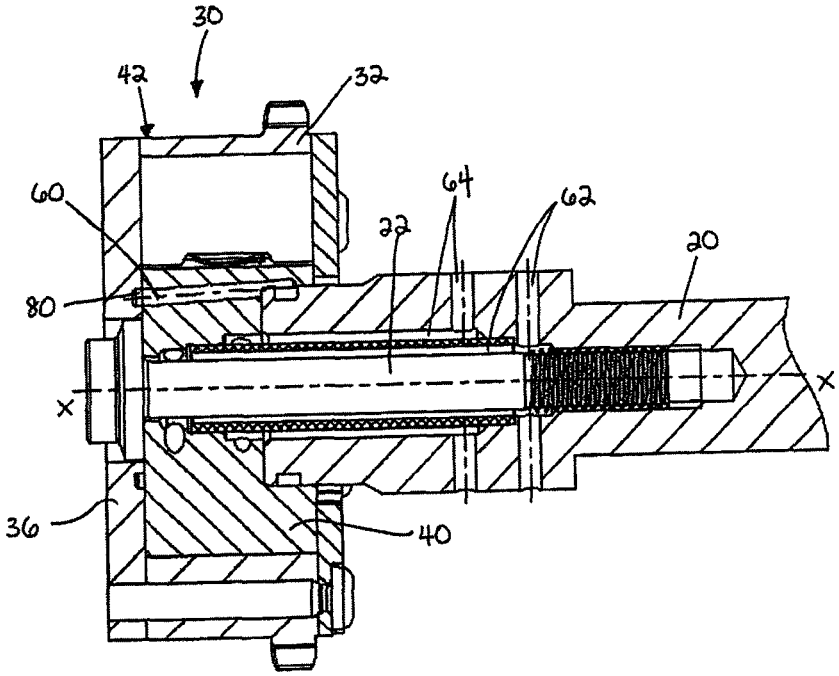
FIG. 4 is a cross-sectional view taken along line 4-4 of the camshaft adjustment mechanism shown in FIG. 1
Figure 5:
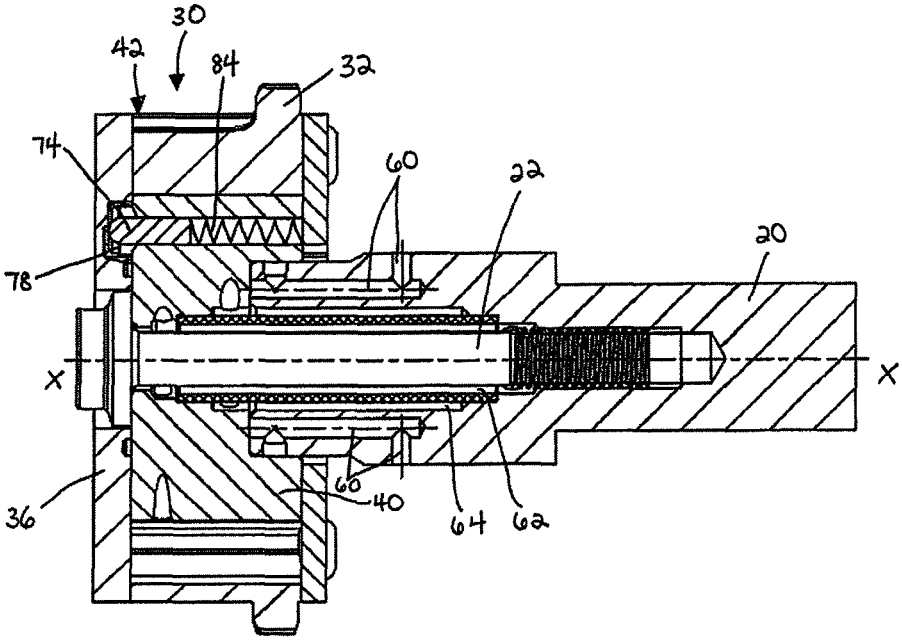
FIG. 5 is a cross-sectional view taken along line 5-5 of the camshaft adjustment mechanism shown in FIG. 1.
Figure 9:
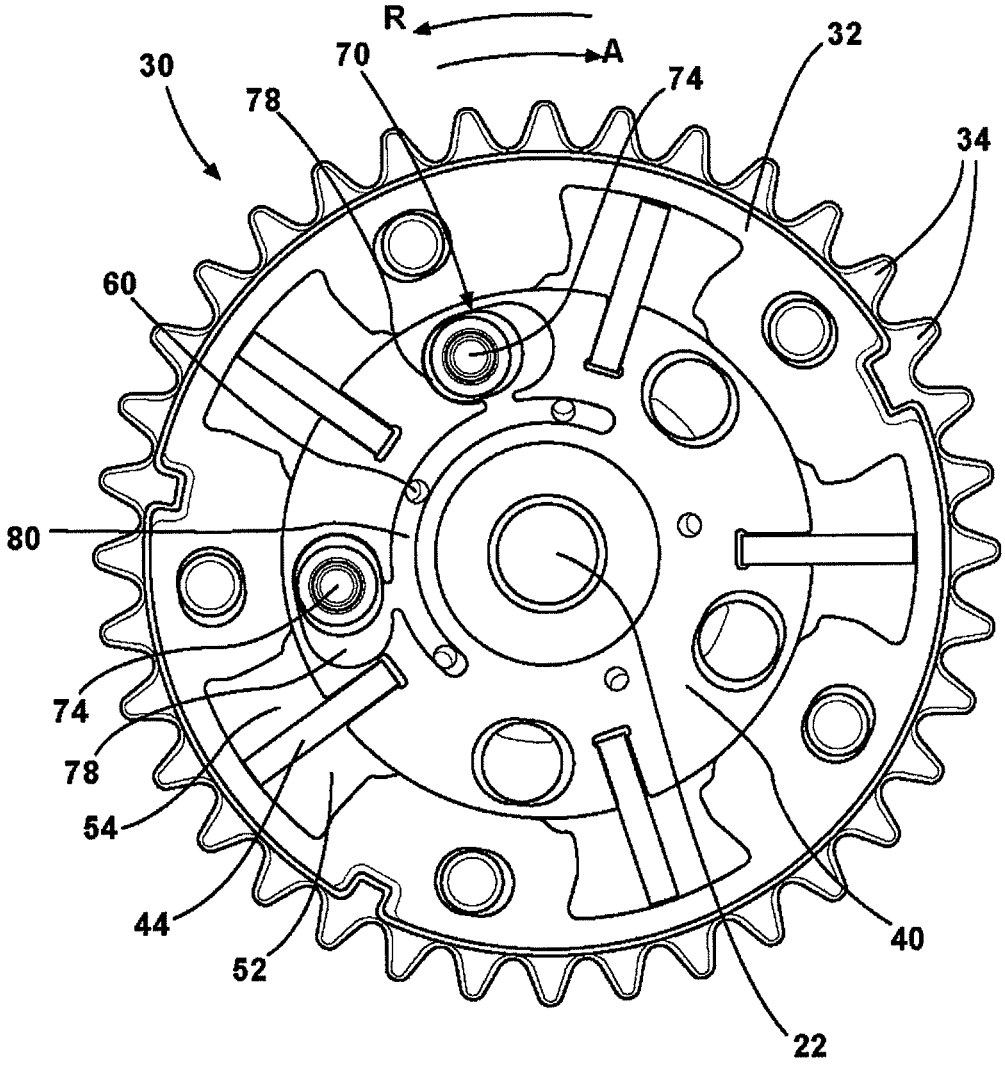
FIG. 9 is a cross-sectional view of another embodiment of the present camshaft adjustment mechanism having a different number of vanes and advance/retard chambers.

FIGS. 1-5 show an embodiment of a camshaft adjustment mechanism 30 according to the present application. The camshaft adjustment mechanism 30 is adapted to be coupled to a camshaft 20 to advance or retard the timing of the camshaft 20 relative to a crankshaft (not shown), which can be used in automotive applications to vary the intake or exhaust valve timing. As shown in FIGS. 1, 4, and 5, the camshaft adjustment mechanism 30 includes a rotor 40 adapted to be connected to the camshaft 20 and to rotate between an advanced position and a retarded position. The rotor 40 is arranged inside of a housing 42, which can include a stator 32 and a cover 36 associated with the stator 32. Alternatively, the cover 36 can be formed integrally with the stator 32. The camshaft adjustment mechanism 30 can include a pulley, sprocket, or gear, with a plurality of teeth 34 formed on the outer surface of the stator 32 for engaging a drive mechanism such as a chain, belt, or gear. The rotor 40 can be associated with the camshaft 20 through any suitable means, such as through a mechanical fastener 22 as shown in FIGS. 4 and 5. One of ordinary skill in the art will appreciate that other methods, such as welding or a force-fit, can be used to connect the rotor 40 and the camshaft 20. An advance chamber 52 and a retard chamber 54 are formed between the rotor 40 and the stator 32, the advance and retard chambers 52, 54 being separated so that they are not in fluid communication with each other. The rotor 40 can include a radially extending vane 44 that separates the advance chamber 52 from the retard chamber 54, which are arranged adjacent to each other. The vane 44 can be formed as a separate component that is attached to the rotor 40, or alternatively can be formed integrally with the rotor 40. As shown in FIGS. 3 and 9, the camshaft adjustment mechanism 30 can include a plurality of vanes 44 that separates a plurality of advance and retard chambers 52, 54 from each other. The vanes 44, advance chambers 52, and retard chambers 54 are preferably evenly arranged circumferentially around the rotational axis X of the camshaft adjustment mechanism 30.

Figure 6:
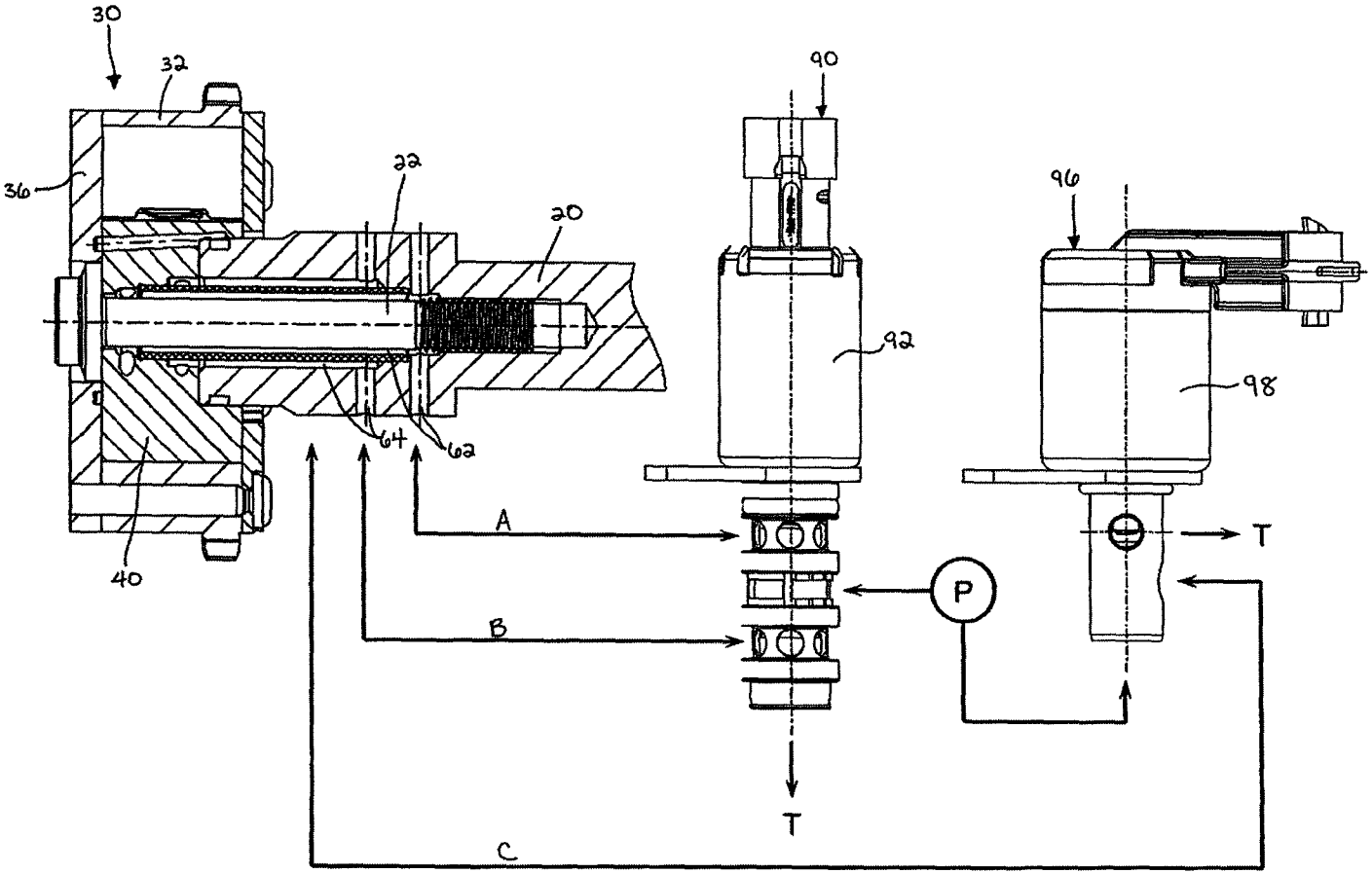
FIG. 6 is a simplified schematic view of a camshaft adjustment mechanism and oil control valve configuration according to the present invention.

As shown in FIGS. 2, 3, 5, and 9, the camshaft adjustment mechanism 30 further includes a locking apparatus 70 adapted to lock the rotor 40 in position relative to the stator 32. The locking apparatus 70 is controlled independently of the advancing and retarding operation of the camshaft adjustment mechanism 30, and can be used to lock the rotor 40 in a desired engine start position. Preferably, the locking apparatus 70 locks the rotor 40 in an intermediate position between the most advanced position and the most retarded position. A locking mechanism that can be locked in such an intermediate position is generally known as a "mid-lock mechanism" or "intermediate locking mechanism," even though the locked position does not necessarily need to be at the exact mid-point between the most advanced and retarded positions. As shown in FIG. 6, a first oil control valve 90 is associated with the advance chamber 52 and the retard chamber 54 to control oil flow to the advance and retard chambers 52, 54 for adjusting the camshaft timing, and a second oil control valve 96 is associated with the locking apparatus 70 to control oil flow to the locking apparatus 70 for actuating the locking apparatus 70 between a locked position and an unlocked position. The first and second oil control valves 90, 96 are independently actuatable, and can each include a respective first or second solenoid 92, 98 that drives the valve.

As shown in FIGS. 4-6, the camshaft adjustment mechanism 30 includes a locking oil passage 60, an advance oil passage 62, and a retard oil passage 64 formed in the camshaft 20 and the rotor 40. The advance oil passage 62 is in communication with the advance chamber 52 and the first oil control valve 90. The retard oil passage 64 is in communication with the retard chamber 54 and the first oil control valve 90. The locking oil passage 60 is separate from the advance and retard oil passages 62, 64 and is in communication with the locking apparatus 70 and the second oil control valve 96. To advance or retard the camshaft timing, the first oil control valve 90 is used to supply oil to the advance and/or retard chambers 52, 54 through the advance and retard oil passages 62, 64. The arrangement of the advance and retard chambers 52, 54 in the camshaft adjustment mechanism 30 depends on the rotational direction of the camshaft 20. For most engines where the camshaft 20 rotates in a clockwise direction C, as shown in FIGS. 3 and 9, the camshaft adjustment mechanism 30 can advance the camshaft timing by rotating the rotor 40 clockwise relative to the stator 32 in the advancing direction A, and retard the camshaft timing by rotating the rotor 40 counterclockwise relative to the stator 32 in the retarding direction R. Making reference to FIG. 3, an advance chamber 52 is arranged on the left side of the topmost vane 44, and a retard chamber 54 is arranged on the right side of that vane 44. To advance the camshaft timing, the first oil control valve 90 is actuated to supply oil through the advance oil passage 62 to fill the advance chamber 52, which rotates the rotor 40 clockwise in the advancing direction A. To retard the camshaft timing, the first oil control valve 90 is actuated to supply oil through the retard oil passage 64 to fill the retard chamber 54, which rotates the rotor 40 counterclockwise in the retarding direction B. As the retard chamber 54 is being filled with oil, the oil in the advance chamber 52 is simultaneously drained, and vice versa. Additionally, the first oil control valve 90 can close both the advance and retard oil passages 62, 64 to maintain oil in both the advance and retard chambers 52, 54 to hold the desired shift in camshaft timing. The first oil control valve 90 is preferably driven by the first solenoid 92 and commanded by the engine control unit.

Figure 10:
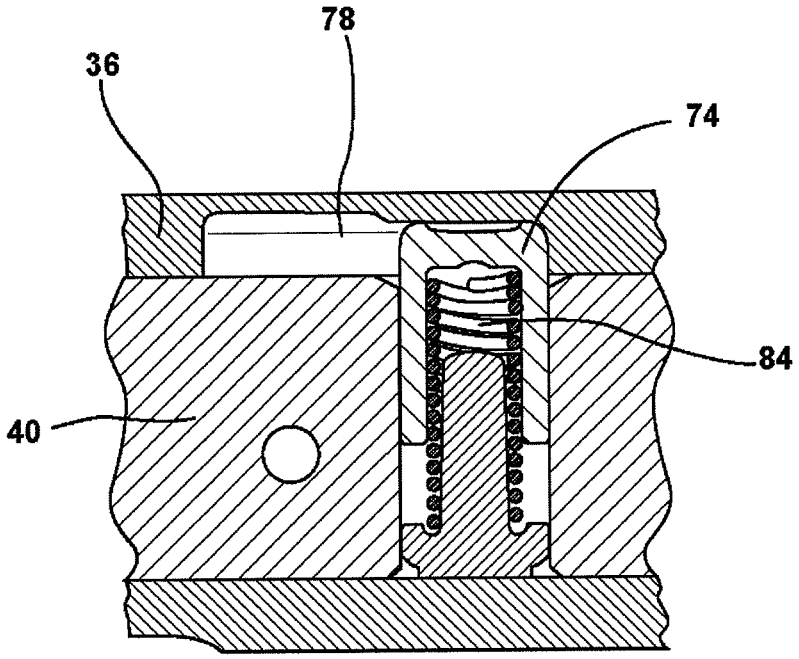
FIG. 10 is a fragmentary cross-sectional view of a locking pin of the camshaft adjustment mechanisms shown in FIG. 1 or 9.

The locking apparatus 70 of the present camshaft adjustment mechanism 30 preferably includes a pair of locking pins 74 associated with the rotor 40 and at least one locking groove 78 formed in the cover 36, as shown in FIGS. 2, 3, and 9. Although a pair of locking grooves 78 can be provided, as shown in FIGS. 2 and 9, one of ordinary skill in the art would appreciate that a single locking groove 78 can be used instead to engage the pair of locking pins 74. The single locking groove 78 can, for example and without limitation, be a circumferentially extending groove formed in the cover 36 having two end portions adapted to engage the pair of locking pins 74, respectively. The pair of locking grooves 78 are in communication with the locking oil passage 60, for example through an oil channel 80 that connects to both locking grooves 78. The oil channel 80 can be formed in the cover 36 (as shown in FIG. 2), or formed in the rotor 40, or formed in both the cover 36 and the rotor 40 in an overlapping configuration (as shown in FIG. 9). The locking pins 74 are adapted to move relative to the rotor 40 between an extended and a retracted position to selectively engage and disengage the pair of locking grooves 78, or a single locking groove 78 with one locking pin 74 arranged at each end of the locking groove 78. Each one of the locking pins 74 has an associated spring element 84, as shown in FIGS. 5 and 10, that biases the locking pin 74 outwardly towards the extended position to engage the corresponding locking groove 78 in the cover 36. The spring element 84 can be, for example and without limitation, a compression spring.

When the locking apparatus 70 is in the locked position, the locking grooves 78 in the cover 36 have very low oil pressure or no oil, and the force applied by the spring elements 84 biases the locking pins 74 outwardly to engage the locking grooves 78, as shown in FIGS. 5 and 10. Because the heads of the locking pins 74 are received in the locking grooves 78, the rotor 40 cannot rotate with respect to the cover 36 and the stator 32. Making reference to FIG. 9, which shows the locking apparatus 70 in the locked position, the top locking pin 74 is positioned at an end portion of the top locking groove 78, which prevents the rotor 40 from rotating clockwise relative to the stator 32 in the advancing direction A. The bottom locking pin 74 is similarly positioned at an end portion of the bottom locking groove 78, which prevents the rotor from rotating counterclockwise in the retarding direction R. Where a single locking groove 78 is formed in the housing instead of a pair of locking grooves 78, the top locking pin 74 would be positioned at a top end portion of the single locking groove 78, while the bottom locking pin 74 would be positioned at a bottom end portion of the single locking groove 78. To unlock the locking apparatus 70, the second oil control valve 96 is actuated to supply oil through the locking oil passage 60 to the oil channel 80 formed in at least one of the cover 36 or rotor 40 to fill the locking grooves 78. As the locking grooves 78 are filled with oil, the oil pressure overcomes the biasing force applied by the spring elements 84 associated with the locking pins 74 and forces the locking pins 74 inwardly towards the retracted position to disengage the locking grooves 78. The rotor 40 is then free to rotate with respect to the cover 36 and the stator 32. The second oil control valve 96 is preferably driven by the second solenoid 98 and commanded by the engine control unit. To lock the locking apparatus 70 so that the rotor 40 can be maintained in an intermediate position between the most advanced and the most retarded positions, the second oil control valve 96 is actuated to allow oil to drain from the locking grooves 78 through the oil channel 80 and the locking oil passage 60. As the oil pressure within the locking grooves 78 drops, the biasing force applied by the spring elements 84 associated with the locking pins 74 forces the locking pins outwardly towards the extended position to engage the locking grooves 78 and lock the rotor 40 from rotation. This is preferably done in conjunction with positioning of the rotor 40 via the first oil control valve 90.

Although the locking apparatus 70 shown in FIGS. 2 and 3 include a single locking oil passage 60 that supplies oil to both locking grooves 78 through an oil channel 80 that connects the two locking grooves 78, one of ordinary skill in the art would appreciate that separate locking oil passages 60 can be used to individually supply oil to each locking groove 78, so that each locking pin 74 can be individually actuated between the retracted position and the extended position. The oil passage 60 can be formed in the rotor 40, in the camshaft 20, or in both the rotor 40 and the camshaft 20. Similarly, while the oil channel 80 shown in FIG. 2 extends circumferentially in the cover 36 to connect the locking grooves 78, the oil channel 80 can be formed in different configurations to provide a flow path from the locking oil passage 60 to the locking grooves 78. For example and without limitation, the oil channel 80 can extend radially from the center of the cover 36 towards the locking grooves 78. Where only a single locking groove 78 is provided, an oil channel 80 may not be necessary and the locking oil passage 60 may provide oil directly to the single locking groove 78. One of ordinary skill in the art would further appreciate that mechanisms other than a spring element can be used to bias the locking pins 74 outwardly to engage the locking grooves 78.

As shown in FIG. 6, the present camshaft adjustment mechanism 30 includes separate oil passages and separate oil control valves 90, 96 for controlling oil flow to the advance and retard chambers 52, 54 and to the locking apparatus 70. This configuration presents various advantages over known locking camshaft adjustment mechanisms. By providing a separate locking oil passage 60 to direct oil flow to actuate the locking pins 74 instead of using the same advance and retard oil passages 62, 64 as the advancing and retarding operation, the locking apparatus 70 and the locking operation can be accurately controlled with more reliability under a wide range of engine conditions, since the locking pins 74 are actuated independently of the conditions in the advance and retard chambers 52, 54. In known locking mechanisms having two locking pins controlled by the same oil flow from the advance and retard chambers, respectively, one of the pins can become unlocked when the engine is turned off. This is because the oil flow to the advance and retard chambers and in turn the locking pins are controlled by the same proportional oil control valve. When no current is applied to the proportional oil control valve, the valve is generally opened so that oil is allowed to flow into one of the advance and retard chambers, which can disengage the locking pin associated with that chamber and leave only one locking pin engaged. When the engine is started, the camshaft adjustment mechanism can be uncontrolled and free to rotate in the direction of the unlocked pin, which results in engine start up noise, vibrations, and excessive wear on the locking mechanism. The present camshaft adjustment mechanism 30 solves this problem by separating the oil flow to the locking apparatus 70 from the oil flow to the advance and retard chambers 52, 54. The use of a separate locking oil passage 60 to provide oil to the locking grooves 78 ensures that both locking pins 74 remain engaged during engine stop and startup, so that the rotor 40 is fully locked in the desired intermediate position for optimal engine startup.

The present camshaft adjustment mechanism 30 is further advantageous over known camshaft adjustment mechanisms by independently controlling the locking apparatus with a second oil control valve 96, instead of with the same first oil control valve 90 used to control oil flow into the advance and retard chambers 52, 54. As discussed above, the advancing and retarding operation is generally performed at high engine speeds. If the locking apparatus 70 is controlled by the same first oil control valve 90 that provides oil flow to the advance and retard chambers 52, 54, the locking operation would also have to be performed at those high speeds, which results in poor locking accuracy and reliability, and increased wear on the components of the locking apparatus 70. By using a separate second oil control valve 96 to provide oil flow to the locking oil passage 60 of the locking apparatus 70, the rotor 40 can be locked somewhat independently of the advancing and retarding operation. This allows the locking operation to occur at a slower rotational speed to ensure better locking accuracy and reliability, and makes it easier to control the exact position of the rotor 40 when the locking apparatus 70 is actuated since it is controlled separately. Although the first and second oil control valves 90, 96 can be supplied with oil from the same oil source P, as shown in FIG. 6, the first and second oil control valves 90, 96 independently regulate the oil flow for the advancing/retarding and locking operations, respectively.

Figure 7:
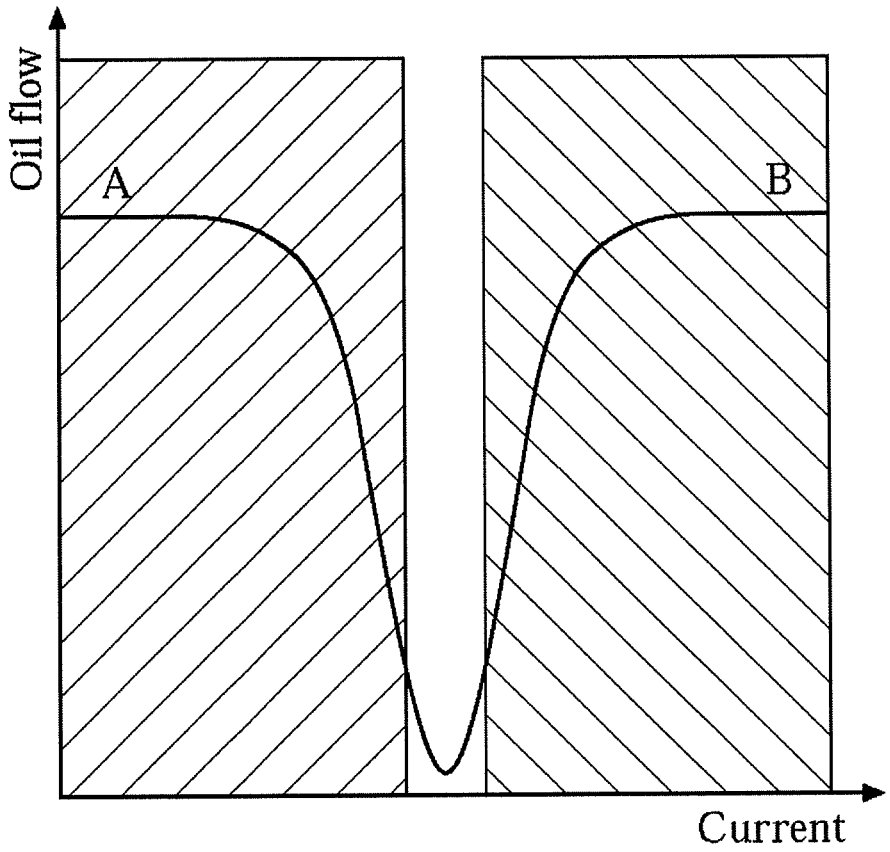
FIG. 7 is a graph showing the oil flow characteristic of one of the oil control valves shown in FIG. 6.

In the simplified schematic shown in FIG. 6, the first oil control valve 90 can be, for example and without limitation, a 4/3 way control valve. The first oil control valve 90 receives oil from an oil source P, supplies oil to and receives oil from the advance oil passage 62 as shown by line A, supplies oil to and receives oil from the retard oil passage 64 as shown by line B, and drains oil as shown by line T. The second oil control valve 96 can be, for example and without limitation, an on/off valve that receives oil from an oil source P, supplies oil to and receives oil from the locking oil passage 60 as shown by line C, and drains oil as shown by line T. The graph shown in FIG. 7 illustrates the oil flow characteristic through the first oil control valve 90 at different current inputs. When no current is supplied to the first solenoid 92 of the first oil control valve 90, the flow through line A to the advance oil passage 62 is at a maximum. As current is applied to the first solenoid 92, the feed openings for line A becomes blocked by a spool inside of the first solenoid 92 and the flow through line A decreases. At the middle unshaded area of the graph in FIG. 7, the spool inside of the first solenoid 92 blocks both of the feed openings for lines A and B. This is commonly known as the control position. As more current is applied to the first solenoid 92, the feed opening for line B becomes unblocked by the spool, and the flow through line B to the retard oil passage 64 increases. By adjusting the current provided to the first solenoid 92 of the first oil control valve 90, the oil flow to the advance and retard oil passages 62, 64 and the advance and retard chambers 52, 54 can be regulated and fine tuned by the engine control unit.

Figure 8:
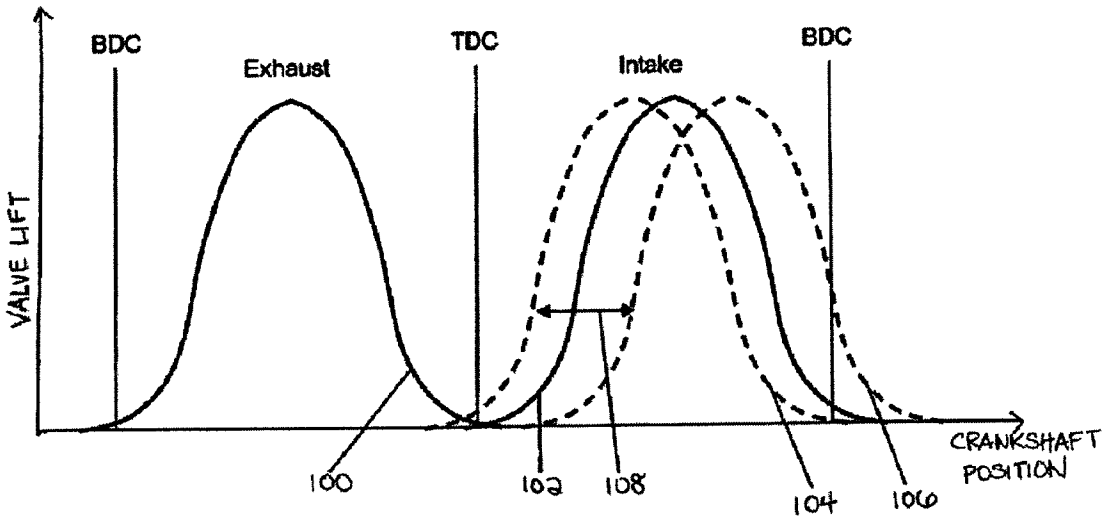
FIG. 8 is a graph showing the timing adjustments that can be achieved with the camshaft adjustment mechanism shown in FIG. 1.

The graph shown in FIG. 8 is a valve opening diagram that illustrates the valve lift for the exhaust and intake valves of a vehicle engine between the end of the power stroke and the beginning of the compression stroke. The X axis represents the crankshaft position and the Y axis represents the valve lift position. At the end of the power stroke, the engine piston is at bottom dead center (BDC). To release exhaust, the exhaust valve opens and closes as represented by the exhaust valve timing line 100. When the engine piston reaches approximately top dead center (TDC), the intake stroke begins as the intake valve is opened and closed. The present camshaft adjustment mechanism 30 can be used to adjust the timing of the exhaust valve, the intake valve, or both valves with respect to the crankshaft timing. The dotted most- advanced intake valve timing line 104 represents the timing of the intake valve when the camshaft adjustment mechanism 30 shifts the camshaft associated with the intake valve to the most advanced timing angle, and the dotted most-retarded intake valve timing line 106 represents the timing of the intake valve when the camshaft adjustment mechanism 30 shifts the camshaft associated with the intake valve to the most retarded timing angle. There is an adjustment range 108 between the most advanced and most retarded intake valve timing, and the locking apparatus 70 can be used to lock the camshaft adjustment mechanism 30 at an intermediate position between the most advanced and most retarded positions, as shown by the solid intermediate intake valve timing line 102. A locking apparatus 70 that allows for precise and reliable locking of the camshaft adjustment mechanism 30 at this intermediate position helps optimize the engine start conditions. In known camshaft adjustment mechanisms without an intermediate locking mechanism, the camshaft adjustment mechanism is usually locked at either the most advanced or the most retarded position and is required to start at that position when the engine is started and can only move in one direction for subsequent adjustment. In the present camshaft adjustment mechanism 30, the locking apparatus 70 allows the rotor 40 to be locked at a desired intermediate position and then adjusted towards either the advanced or retarded position when the engine is started.

A method of locking a camshaft adjustment mechanism is also disclosed, including the following steps. A camshaft adjustment mechanism 30 with a rotor 40 adapted to be connected to a camshaft 20 is provided. The camshaft adjustment mechanism 30 further includes a housing 42, which can include a stator 32 and a cover 36, arranged around the rotor 40 such that an advance chamber 52 and a retard chamber 54 are formed between the rotor 40 and the housing 42, with a vane 44 extending from the rotor 40 separating the advance and retard chambers 52, 54. An advance oil passage 62 and a retard oil passage 64 are formed in the rotor 40 in communication with the advance chamber 52 and the retard chamber 54, respectively. A first oil control valve 90 is provided to control oil flow through the advance and retard oil passages 62, 64. A locking apparatus 70 is provided that includes a pair of locking pins 74 associated with the rotor 40 and at least one locking groove 78 formed in the housing 42, such as in the cover 36. The locking pins 74 are adapted to move between a retracted position and an extended position. Each one of the locking pins 74 is preferably associated with a spring element 84 that biases the locking pin 74 outwardly towards the extended position, so that the head of the locking pins 74 can engage the at least one locking groove 78 to lock the rotor 40 from rotation relative to the housing 42. A locking oil passage 60 is formed in at least one of the rotor 40 or the camshaft 20 in communication with the at least one locking groove 78 formed in the housing 42. A second oil control valve 96 is provided to control oil flow through the locking oil passage 60. The locking apparatus 70 is actuated between a locked position and an unlocked position by selectively supplying oil from the second oil control valve 96 to the at least one locking groove 78 through the locking oil passage 60, in the manner described in detail above. As discussed with respect to FIG. 6, the first and second oil control valves 90, 96 are independently actuatable, and each preferably includes a respective first and second solenoid 92, 98. The rotor 40 is rotatable between an advanced position and a retarded position, and the locking apparatus 70 is used to lock the rotor 40 in an intermediate position between the advanced and retarded positions, preferably to optimize engine startup.

Having thus described various embodiments of the present camshaft adjustment mechanism and method of locking a camshaft adjustment mechanism in detail, it is to be appreciated and will be apparent to those skilled in the art that many physical changes, only a few of which are exemplified in the detailed description above, could be made in the apparatus and method without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

The invention claimed is:

1. A camshaft adjustment mechanism comprising:

a rotor that is connectable to a camshaft and rotatable between an advanced position and a retarded position, with a vane extending from the rotor;

a stator arranged around the rotor;

a cover associated with the stator;

an advance chamber and a retard chamber formed between the rotor and the stator, the advance chamber and the retard chamber being separated from each other by the vane;

a locking apparatus locks the rotor from rotation relative to the stator;

a first oil control valve associated with the advance chamber and the retard chamber to control oil flow to the advance chamber and the retard chamber; and a second oil control valve associated with the locking apparatus to control oil flow to the locking apparatus via a locking oil passage, wherein the locking apparatus comprises a pair of locking pins located in the rotor and two locking grooves formed in the cover, the locking grooves being in communication with the locking oil passage via an oil passage located in the cover that extends between the locking grooves, and the pair of locking pins are engagable in the locking grooves.

2. The camshaft adjustment mechanism of claim 1, wherein the rotor comprises a plurality of vanes that separates a plurality of advance chambers from a plurality of retard chambers.

3. The camshaft adjustment mechanism of claim 2, wherein the pluralities of vanes, advance chambers, and retard chambers are evenly arranged circumferentially around a rotational axis of the rotor.

4. The camshaft adjustment mechanism of claim 1, wherein the first oil control valve and the second oil control valve are independently actuatable.

5. The camshaft adjustment mechanism of claim 1, wherein the locking apparatus locks the rotor in an intermediate position between the advanced position and the retarded position.

6. The camshaft adjustment mechanism of claim 1, wherein the rotor comprises:

an advance oil passage in communication with the advance chamber and the first oil control valve; and a retard oil passage in communication with the retard chamber and the first oil control valve.

7. The camshaft adjustment mechanism of claim 1, wherein each of the pair of locking pins is associated with a spring element that biases the locking pin towards the at least one locking groove in the cover.

8. The camshaft adjustment mechanism of claim 7, wherein the locking apparatus is actuatable between a locked position in which the pair of locking pins are engaged with the locking grooves such that the rotor cannot rotate relative to the cover, and an unlocked position in which oil from the locking oil passage fills the locking grooves and disengages the pair of locking pins from the locking grooves such that the rotor is free to rotate relative to the cover.

9. A camshaft adjustment mechanism comprising:

a rotor arranged inside of a housing, the rotor is connectable to a camshaft;

an advance chamber and a retard chamber formed between the rotor and the housing, and separated by a vane extending from the rotor;

an independently controlled locking apparatus that locks the rotor from rotating relative to the housing;

a first oil control valve that controls oil flow to the advance chamber and the retard chamber to actuate the rotor between an advanced position and a retarded position;

a second oil control valve that controls oil flow to the locking apparatus via a locking oil passage to actuate the locking apparatus between a locked position and an unlocked position, wherein the locking apparatus comprises a pair of locking pins located in the rotor and two locking grooves formed in the cover, the locking grooves being in communication with the locking oil passage via an oil passage located in the cover that extends between the locking grooves, and the pair of locking pins are engagable in the locking grooves.

10. The camshaft adjustment mechanism of claim 9, wherein the rotor includes an advance oil passage in communication with the advance chamber and the first oil control valve, and a retard oil passage in communication with the retard chamber and the first oil control valve, wherein the advance oil passage, the retard oil passage, and the locking oil passage are separate from each other.

11. The camshaft adjustment mechanism of claim 9, wherein the locking apparatus is actuated to the unlocked position by supplying oil from the second oil control valve through the locking oil passage into the locking grooves formed in the housing, which disengages the pair of locking pins from the locking grooves, and the locking apparatus is actuated to the locked position by draining oil from the locking grooves from the housing through the locking oil passage into the second oil control valve, which allows the pair of locking pins to engage the locking grooves formed in the housing.

12. A method of locking a camshaft adjustment mechanism, the method comprising:

providing a camshaft adjustment mechanism having a rotor that is connected to a camshaft, a housing arranged around the rotor, such that an advance chamber and a retard chamber are formed between the rotor and the housing and separated by a vane extending from the rotor, an advance oil passage in the rotor in communication with the advance chamber, and a retard oil passage in the rotor in communication with the retard chamber;

providing a first oil control valve that controls oil flow through the advance oil passage and the retard oil passage;

providing a locking apparatus comprising a pair of locking pins associated with the rotor and two locking grooves formed in the housing, the pair of locking pins being movable between a retracted position and an extended position;

providing a locking oil passage in the rotor or the camshaft in communication with the locking grooves formed in the housing via an oil passage located in a cover of the housing that extends between the locking grooves;

providing a second oil control valve that controls oil flow through the locking oil passage; and actuating the locking apparatus between a locked position and an unlocked position by selectively supplying oil from the second oil control valve to the locking grooves formed in the housing.

13. The method of claim 12, wherein the first oil control valve and the second oil control valve are independently actuatable.

14. The method of claim 12, wherein each of the first oil control valve and the second oil control valve includes a solenoid.

15. The method of claim 12, wherein the first oil control valve and the second oil control valve are both in communication with a common oil source.

16. The method of claim 12, wherein the rotor is rotatable between an advanced position and a retarded position, and the locking apparatus is used to lock the rotor in an intermediate position between the advanced position and the retarded position.

17. The method of claim 12, wherein each of the pair of locking pins is associated with a spring element that biases the locking pin towards the extended position.

* * * * *